US006481208B1

(12) United States Patent
Nadig

(10) Patent No.: US 6,481,208 B1
(45) Date of Patent: Nov. 19, 2002

(54) EXTERNAL STEAM DUMP

(75) Inventor: Ranga Nadig, Cherry Hill, NJ (US)

(73) Assignee: Holtec International, Marlton, NJ (US)

( * ) Notice: Subject to any disclaimer, the term of this patent is extended or adjusted under 35 U.S.C. 154(b) by 0 days.

(21) Appl. No.: 09/969,277

(22) Filed: Oct. 1, 2001

(51) Int. Cl.[7] ..... F01B 31/06
(52) U.S. Cl. ..... 60/687; 60/690
(58) Field of Search ..... 60/685, 687, 690

(56) References Cited

U.S. PATENT DOCUMENTS 4,027,996 A 6/1977 Keller et al.
4,530,212 A 7/1985 Von Schwerdtner et al.
4,550,569 A 11/1985 Isa et al.
4,772,178 A 9/1988 Miller
4,905,474 A * 3/1990 Larinoff ..... 60/692
4,956,978 A * 9/1990 Bleck et al. ..... 62/239
5,185,925 A * 2/1993 Ryan et al. ..... 29/890.049
5,199,387 A * 4/1993 Ap ..... 123/41.25
5,555,739 A * 9/1996 Kujirai et al. ..... 62/244

* cited by examiner

*Primary Examiner*—Hoang Nguyen
(74) *Attorney, Agent, or Firm*—Michael B. Fein; Cozen O'Connor

(57) ABSTRACT

A system and method for reducing the damaging effects of bypass steam in a cylindrical steam surface condenser in a steam turbine/bypass power plant application consisting of a hat-like steam admission chamber located external to the condenser shell having a header with orifices and dummy rods or tubes arranged between the bypass header and the condensing tubes.

15 Claims, 2 Drawing Sheets

BYPASS STEAM INLET DETAIL

BYPASS STEAM INLET DETAIL

DUAL BYPASS STEAM INLET DETAIL

EXTERNAL STEAM DUMP

BACKGROUND OF THE INVENTION

This invention relates to power generating systems and methods of introduction of bypass steam into steam surface condensers.

The primary function of steam surface condensers in a power plant application is to condense the turbine exhaust steam. In certain applications such as combined cycle plants, trash to steam plants, etc., the steam surface condenser is required to condense the steam that has bypassed the steam turbine. In the bypass scenario, the steam turbine is usually not functioning. The steam from the steam generating devices bypasses the steam turbine and is admitted to the condenser at a suitable pressure and temperature.

In large rectangular condensers the bypass steam is admitted in a steam dome. Such steam domes have large steam spaces and provide ample space for the bypass steam to expand and dissipate it's energy.

In cylindrical condensers, however, the steam space adjacent to the tubes is very limited, requiring the bypass steam to expand in confined spaces. The design of dump inlet headers, therefore, is very critical. During expansion, the bypass steam must not cause any damage to the condenser shell internals. The bypass steam must be permitted flow into the all parts of the tube bundle and condense efficiently.

In cylindrical steam surface condensers, the bypass steam is usually admitted in the confined space between the shell of the condenser and the tubes, or in the steam inlet. If admitted in the confined space between the shell and the tubes, the expanding bypass steam tends to cause damage to the tubes and the shell. If admitted in the steam inlet, the bypass header tends to block the flow of incoming turbine exhaust steam, thereby affecting the performance of the condenser. In each of the conventional systems for admission, the shell internals are exposed to the damaging effects of expanding bypass steam. Repairing of replacing the damaged shell internals is a very time consuming and expensive proposition.

It is an object of the present invention to avoid the damaging effect of introducing bypass steam to cylindrical steam surface condensers in power generating steam turbine systems.

It is another object of the invention to introduce bypass steam to cylindrical steam surface condensers with greatly reduced damage to the condensing tubes and other shell internal components.

A further object is to introduce bypass steam to condensers with reduced noise.

SUMMARY OF THE INVENTION

These objects, and others which will become apparent from the following disclosure and drawings, are achieved by the present invention which comprises in one aspect a system for introducing bypass steam to a cylindrical steam surface condenser, the condenser having condensing tubes and a condenser shell, the condenser shell with a opening to accept bypass steam, the system comprising a hat-like steam admission chamber external to the condenser shell, the admission chamber adapted to fit the opening in the condenser shell, the admission chamber including a header having orifices arranged within the admission chamber, the system also comprising dummy rods or tubes located above the tube between the condensing tubes and the opening.

In another aspect, the invention comprises method of introducing bypass steam to a cylindrical steam surface condenser having a condenser shell and condensing tubes comprising providing an opening in the condenser shell and a hat-like steam admission chamber external to the circumference of the condenser shell; securing the admission chamber to the opening in the condenser shell, the admission chamber including a header having orifices arranged within the admission chamber; and providing dummy rods or tubes arranged within the circumference of the condenser between the condensing tubes and the opening to buffer the impact of the bypass steam released through the orifices prior to the bypass steam reaching the condensing tubes.

It is preferred to construct the bypass inlet header of stainless steel. The header can be a single steam inlet with orifices for release of the steam into the admission chamber, or can be two or more steam inlets with orifices which can be arranged one within the other. In embodiments of header systems with two steam inlets, a low pressure inlet can be inside a high pressure inlet.

It is preferred to construct the admission chamber of a large lower cylinder and a large upper cylinder, with the lower cylinder welded to the opening, and the upper cylinder welded to the lower cylinder. Alternatively the upper cylinder can be directly welded to the opening in the condenser. The upper cylinder can have a cover with an opening through which the header is arranged.

The hat-like steam admission chamber is preferably covered with a suitable material to reduce the noise emanating from the expanding steam.

DETAILED DESCRIPTION OF THE PREFERRED EMBODIMENTS

Figure 1:
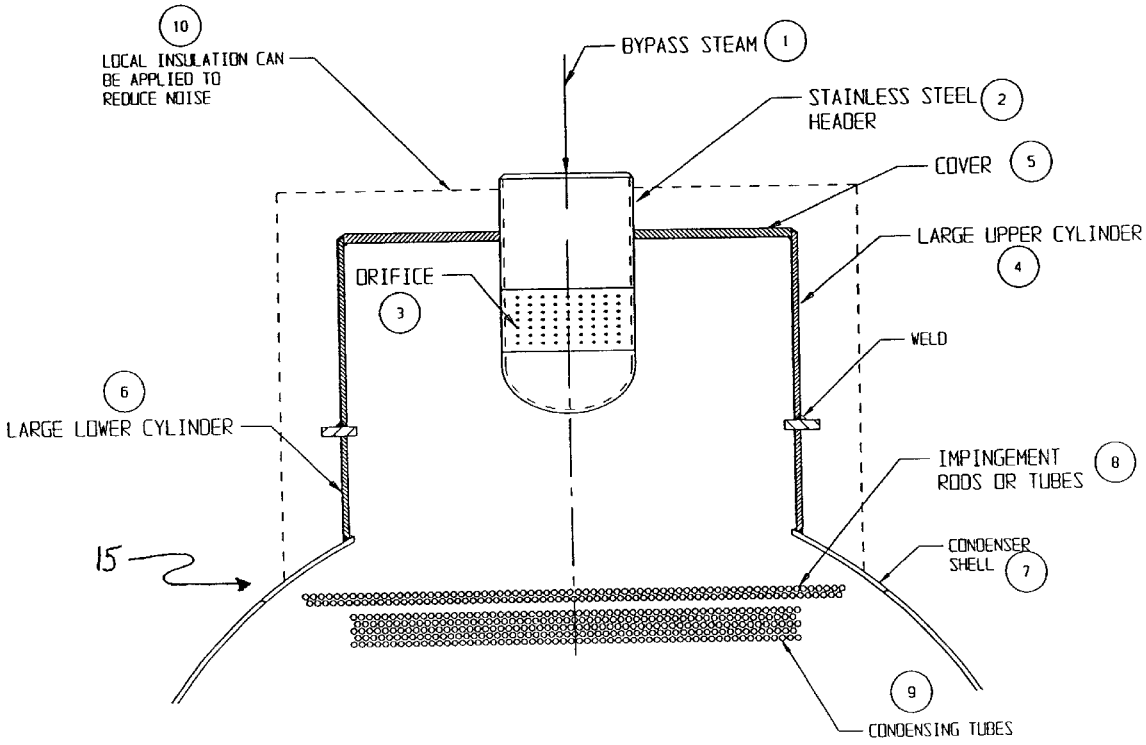
FIG. 1 is a cross-sectional view of a hat-like steam admission chamber with a single header according to the invention.

Referring to FIG. 1, bypass steam 1 flows into the condenser 15 through a stainless steel header 2. The stainless steel header 2 is equipped with orifices 3. The stainless steel header 2 is installed in a cover which is welded on top of a large upper cylinder 4. The large upper cylinder 4 is welded to a large lower cylinder 6. The large lower cylinder 6 is welded to the cylindrical condenser shell 7 (upper portion of shell is illustrated). Two rows of dummy infringement rods or tubes 8 are installed above the condensing tubes 9 so as to protect the condensing tubes from the impact of the bypass steam 1 released through the orifices 3.

Sound insulation is arranged on in the external surfaces of the large upper cylinder 4, lower cylinder 6, header 2, and cover to reduce the noise emanating form expanding steam in dump mode.

Figure 2:
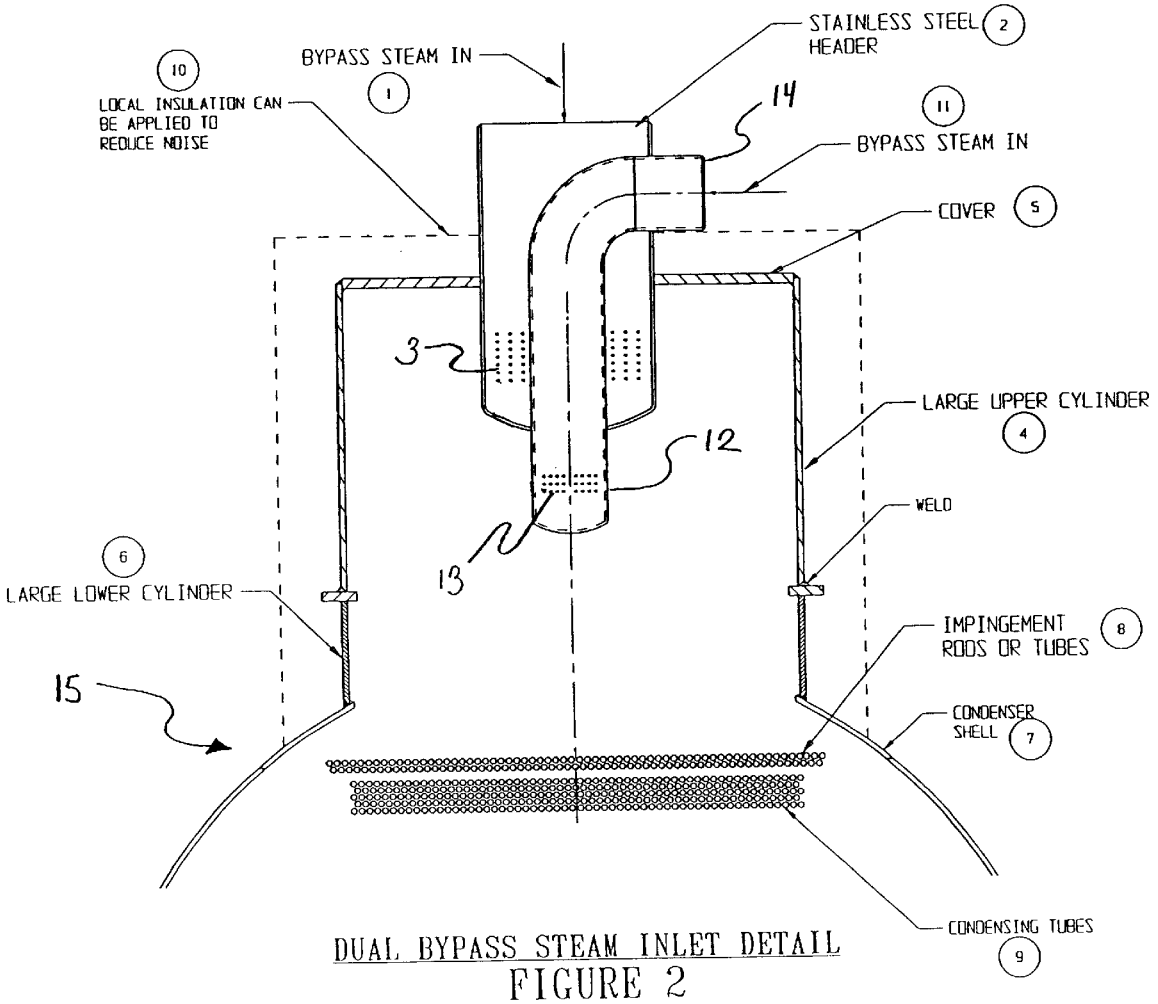
FIG. 2 is a cross-sectional view of a hat-like steam admission chamber with dual headers, according to a second embodiment of the invention. The dual header arrangement can similarly be adapted to multiple inlet header arrangement.

Referring now to FIG. 2, a dual bypass steam inlet is illustrated wherein a second inlet 14 for lower pressure bypass steam 11 directs steam through a second header 12 arranged within first high pressure header 2 and having a second set of orifices 13. In this embodiment, bypass steam is introduced at multiple pressures into the condenser 15. The second stream of bypass 11 steam is admitted through a second header 12 constructed of stainless steel pipe installed inside first bypass header pipe 2. The height of the large upper cylinder 4 is larger in this second embodiment so as to provide adequate expanding height for the two streams of bypass steam 1 and 11.

More than two headers and sets of orifices can be provided if desired, and each can handle bypass steam at different pressures.

When the system is in bypass mode, bypass steam 1 flows through the stainless steel header 2 (or headers 2 and 12), and expands through the orifices 3 (or 3 and 13 according to the second embodiment). The expanding steam with high velocity impinges on the inner walls of the large upper cylinder 4. The large upper cylinder 4 is located external to the condenser shell 7 and absorbs the brunt of the energy from the expanding bypass steam. The bypass steam bounces off the inner walls of the large upper cylinder 4 and impinges on the dummy infringement rods or tubes 8 prior to impacting on the condensing tubes 9. The dummy infringement rods or tubes 8 present a second line of defense against the damaging effects of the expanding bypass steam. The bypass steam then enters the condensing tube bundle 9 carrying cold water. The hot steam comes in contact with the cold tubes 9 and condenses.

The expanding bypass steam create loud noise. These noise levels can be reduced by treating the inner walls of the large upper cylinder 4 or applying sound insulation on the external surfaces of large cylinders 4 and 6. In the event of excessive erosion or corrosion, the entire top section consisting of the large upper cylinder 4, cover 5, large lower cylinder 6, and the inner stainless steel header 2 (or headers 2 and 12) can be replaced for a relatively small expense in a very short amount of time.

The system and method of the invention provide several advantages over prior systems and methods as a result of the bypass steam expanding externally to the condenser shell containing the tubes. The energy of the expanding steam is absorbed by a cylinder which is not a part of the main shell. If damaged in regular or transient operation, the entire upper section of the bypass inlet arrangement can be replaced easily and inexpensively. This system allows reduction of high noise levels by applying local sound insulation around the cylinders 4 and 8, header 2 and optional header 12, and any additional headers, or by treating the inside surface of the cylinders 4 & 6.

The design is easily adaptable to multiple bypass admission streams.

While the invention and the preferred embodiments have been described in detail, various alternative embodiments, alternatives, and improvements should become apparent to those skilled in the art without departing from the spirit and scope of the invention.

What is claimed is:

1. A system for introducing bypass steam to a cylindrical steam surface condenser, the condenser having condensing tubes and a condenser shell, the condenser shell having a circumference and an opening in the circumference, the system comprising a hat-like steam admission chamber external to the circumference of the condenser shell, the admission chamber adapted to fit the opening in the condenser shell, the admission chamber including a header having orifices arranged within the admission chamber, the system also comprising dummy rods or tubes arranged within the circumference of the condenser between the condensing tubes and the opening.

2. The system of claim 1 wherein the bypass inlet header is made from stainless steel.

3. The system of claim 1 wherein the hat-like steam admission chamber and header are covered by sound insulation.

4. The system of claim 1 wherein the hat-like admission chamber is comprised of a lower cylinder welded to the opening, an upper cylinder which is welded to the lower cylinder (the upper cylinder can be directly welded to the shell), and a cover on the upper cylinder, and the header is arranged within an opening in the cover, the header being adapted to receive bypass steam from outside the admission chamber and allow the bypass steam to enter the admission chamber through the orifices, wherein the impingement rods or tubes are arranged to protect the condensing tubes from the impact of the bypass steam released through the orifices prior to the bypass steam reaching the condensing tubes.

5. The system of claim 1 wherein the header includes two bypass steam inlets and two sets of orifices.

6. The header of claim 1 wherein the hat-like admission chamber is comprised of a lower cylinder welded to the opening, an upper cylinder which is welded to the lower cylinder, and a cover, and the header is arranged within an opening in the cover, the header being constructed of stainless steel, the header adapted to receive bypass steam from outside the admission chamber and allow the bypass steam to enter the admission chamber through the orifices, wherein the impingement rods or tubes are arranged to protect the condensing tubes from the impact of the bypass steam released through the orifices prior to the bypass steam reaching the condensing tubes, and wherein the hat-like steam admission chamber and header are covered by means for sound insulation.

7. The header of claim 6 wherein the header includes two bypass steam inlets and two sets of orifices.

8. A power generating steam turbine apparatus having a cylindrical steam surface condenser section having condensing tubes and a condenser shell, the condenser shell having a circumference and an opening in the circumference, wherein the apparatus has a system for introducing bypass steam to the cylindrical steam surface condenser section according to claim 1.

9. The power generating steam turbine apparatus of claim 8 wherein the hat-like admission chamber is comprised of a lower cylinder welded to the opening, an upper cylinder which is welded to the lower cylinder, and a cover, and the header is arranged within an opening in the cover, the header being adapted to receive bypass steam from outside the admission chamber and allow the bypass steam to enter the admission chamber through the orifices, wherein the impingement rods or tubes are arranged to buffer the impact of the bypass steam released through the orifices prior to the bypass steam reaching the condensing tubes.

10. The power generating steam turbine apparatus of claim 8 wherein the header includes two bypass steam inlets and two sets of orifices.

11. The power generating steam turbine apparatus of claim 8 the hat-like admission chamber is comprised of a lower cylinder welded to the opening, an upper cylinder which is welded to the lower cylinder, and a cover, and the header is arranged within an opening in the cover, the header being constructed of stainless steel, the header adapted to receive bypass steam from outside the admission chamber and allow the bypass steam to enter the admission chamber through the orifices, wherein the impingement rods or tubes are arranged to buffer the impact of the bypass steam released through the orifices prior to the bypass steam reaching the condensing tubes, and wherein the hat-like steam admission chamber and header are covered by means for sound insulation.

12. A method of introducing bypass steam to a cylindrical steam surface condenser having a condenser shell and condensing tubes comprising providing an opening in the condenser shell and a hat-like steam admission chamber external to the circumference of the condenser shell;

securing the admission chamber to the opening in the condenser shell, the admission chamber including a header having orifices arranged within the admission chamber; and providing dummy rods or tubes arranged within the circumference of the condenser between the condensing tubes and the opening to buffer the impact of the bypass steam released through the orifices prior to the bypass steam reaching the condensing tubes.

13. The method of claim 12, further including providing sound insulation around the steam admission chamber and the header.

14. The method of claim 12 wherein the header includes two bypass steam inlets and two sets of orifices.

15. The method of claim 14 where a first bypass steam inlet is inside of a second bypass steam inlet and the second bypass steam inlet carries steam at a higher pressure then the first bypass steam inlet.

* * * * *